US006170739B1

(12) United States Patent
Hansen

(10) Patent No.: US 6,170,739 B1
(45) Date of Patent: Jan. 9, 2001

(54) FLEXIBLE CONTAINER FOR LIQUID

(75) Inventor: Henrik Hansen, Tertnes (NO)

(73) Assignee: Multi-Pak A/S, Sandviken (NO)

( * ) Notice: Under 35 U.S.C. 154(b), the term of this patent shall be extended for 0 days.

(21) Appl. No.: 09/117,192

(22) PCT Filed: Jul. 8, 1996

(86) PCT No.: PCT/NO96/00161

§ 371 Date: Jun. 28, 1999

§ 102(e) Date: Jun. 28, 1999

(87) PCT Pub. No.: WO98/01350

PCT Pub. Date: Jan. 15, 1998

(51) Int. Cl.[7] ..... B65D 5/36; B65D 85/72

(52) U.S. Cl. ..... 229/113; 229/104; 229/117.03; 229/117.06; 47/41.13

(58) Field of Search ..... 229/104, 113, 229/117.03, 117.04, 117.05, 117.06; 47/41.01, 41.13

(56) References Cited

U.S. PATENT DOCUMENTS

| | | | | |
|---|---|---|---|---|
| 393,899 | | 12/1888 | Haines . | |
| 2,276,220 | | 3/1942 | LeVeille, Sr. . | |
| 2,774,187 | | 12/1956 | Smithers . | |
| 2,869,722 | | 1/1959 | Marander et al. . | |
| 3,145,905 | | 8/1964 | Moore . | |
| 3,373,917 | | 3/1968 | Cox . | |
| 3,726,469 | | 4/1973 | Koehler . | |
| 3,912,331 | * | 10/1975 | Turner et al. | 229/104 |
| 4,109,848 | * | 8/1978 | Kipp et al. | 229/104 |
| 4,289,268 | | 9/1981 | Paige . | |
| 4,428,500 | * | 1/1984 | Kohler | 229/117.05 |
| 4,792,086 | | 12/1988 | Chen . | |
| 4,850,509 | * | 7/1989 | Hollenberg | 229/117.05 |
| 5,156,294 | | 10/1992 | Nichols . | |
| 5,788,061 | | 8/1998 | Hammond . | |

FOREIGN PATENT DOCUMENTS

| | | | | |
|---|---|---|---|---|
| 1586523 | | 12/1997 | (DE) . | |
| 2231557 | * | 11/1990 | (GB) | 229/117.05 |
| 943536 | | 3/1996 | (NO) . | |

* cited by examiner

*Primary Examiner*—Gary E. Elkins
(74) *Attorney, Agent, or Firm*—Fulbright & Jaworski, LLP

(57) ABSTRACT

A foldable container made of a liquid resistant carton blank has a bottom bracing and bottom closing tab or portion that provides rigidity when the container is expanded for use.

6 Claims, 10 Drawing Sheets

FLEXIBLE CONTAINER FOR LIQUID

The present invention relates to a container, which is made of a liquid-resistant, planar blank of impregnated cardboard or like material and is formed via folding lines and edge flaps, where the container exists in a starting position in a flat, that is to say folded down condition along a bottom folding line with a double foldable bottom portion, the bottom portion halves of which being adapted to be pulled in by a simple hand grip with a snapped or curved contour along the bottom folding line and thereby hold the container stretched in a ready-for-use condition by means of inherent elastic forces in the bottom portion of the container and adjacent container portions, where a per se liquid-tight container inner portion with an associated bottom portion is connected at opposite edges of the container inner portion to a container outer portion, which forms a bracing, enveloping outer portion for the inner portion.

The afore-mentioned solution is known from NO patent application 943536. In said publication an extra bracing member is proposed which can overlap the bottom portion in the use position and which by means of inherent elasticity together with the elasticity in the bottom portion can ensure the container in place in a use ready condition. It is further proposed to apply separate locking devices, if there is a need for this. Such separate locking devices can for example be fastened to the container at a local portion of its bottom portion by adhesion/welding. Such an extra locking device can if desired be made of another material or of corresponding material, but if desired having greater rigidity.

In practice there is shown a need of being able to effect blocking off the container in a ready stretched out condition so as to be able to prevent unintentional squeezing together of the container.

The container according to the invention is characterised in that a combined bottom-bracing and bottom-closing means is adapted to brace the bottom portion and opposite sides of the container in a direction across a central plane of the container through the bottom folding line of the bottom portion, that the bottom bracing and bottom-closing means comprises a first, permanent bracing section, which is rigidly fastened to the bottom portion on the one side of the bottom folding line, and a second readjustable bracing section, which, when the container is in its flat starting position, projects freely outwards past the bottom folding line, and that the bottom-bracing and bottom-closing means has great inherent rigidity in a direction across the bottom folding line and has a longitudinal dimension across the bottom folding line corresponding to or substantially corresponding to the breadth of the ready-for-use container in a direction across the bottom folding line.

According to the invention a certain local bracing and reinforcement of the bottom portion of the container is achieved, by fastening the combined bottom-bracing and bottom-closing means locally to the bottom portion of the container. In addition there is achieved a possibility for effective bracing and closing off of the bottom portion of the container in the ready-for-use condition of the container, without the danger of unintentional folding together of the container.

Without influencing the ability of the bottom portion to be fixed in an elastically yielding manner, correspondingly as the earlier known solution, the flexibility and elasticity of the bottom portion is utilised in a favourable manner. In addition an extra bracing and closing of the bottom portion is obtained in the intended use position as a consequence of the cooperation of the relatively rigid bottom-bracing and bottom-closing means and the relatively flexible elasticity of the bottom portion.

Further features of the invention will be evident from the following description having regard to the accompanying drawings, in which.

By way of introduction there will be described a container known from NO patent application 943536 and thereafter there will be described a combined bottom bracing and bottom-closing means according to the invention for closing off the container in the use ready condition.

Figure 1:
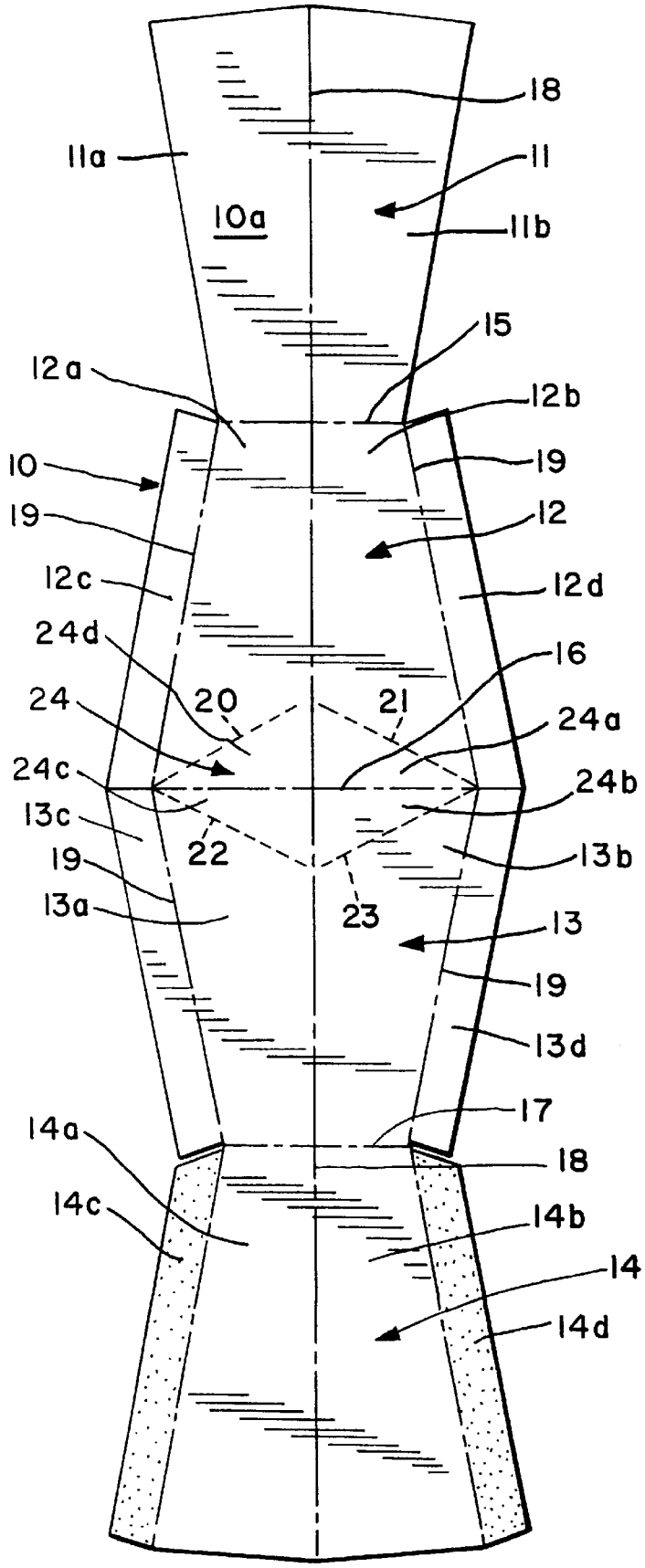
FIG. 1 PRIOR ART
FIG. 1 shows a blank in one piece for the making of a flower vase or similar container according to a known construction.
Figure 2:
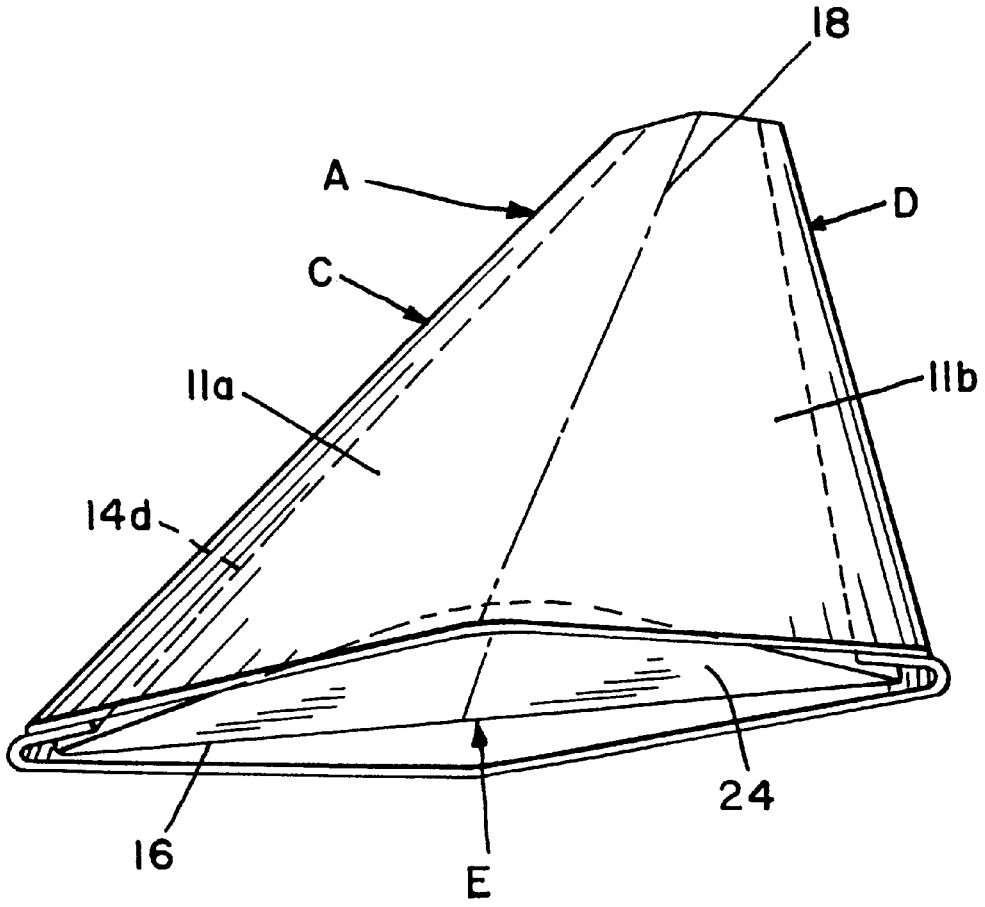
FIG. 2 PRIOR ART
FIG. 2 shows in perspective a folded together container made from the blank according to FIG. 1.
Figure 3:
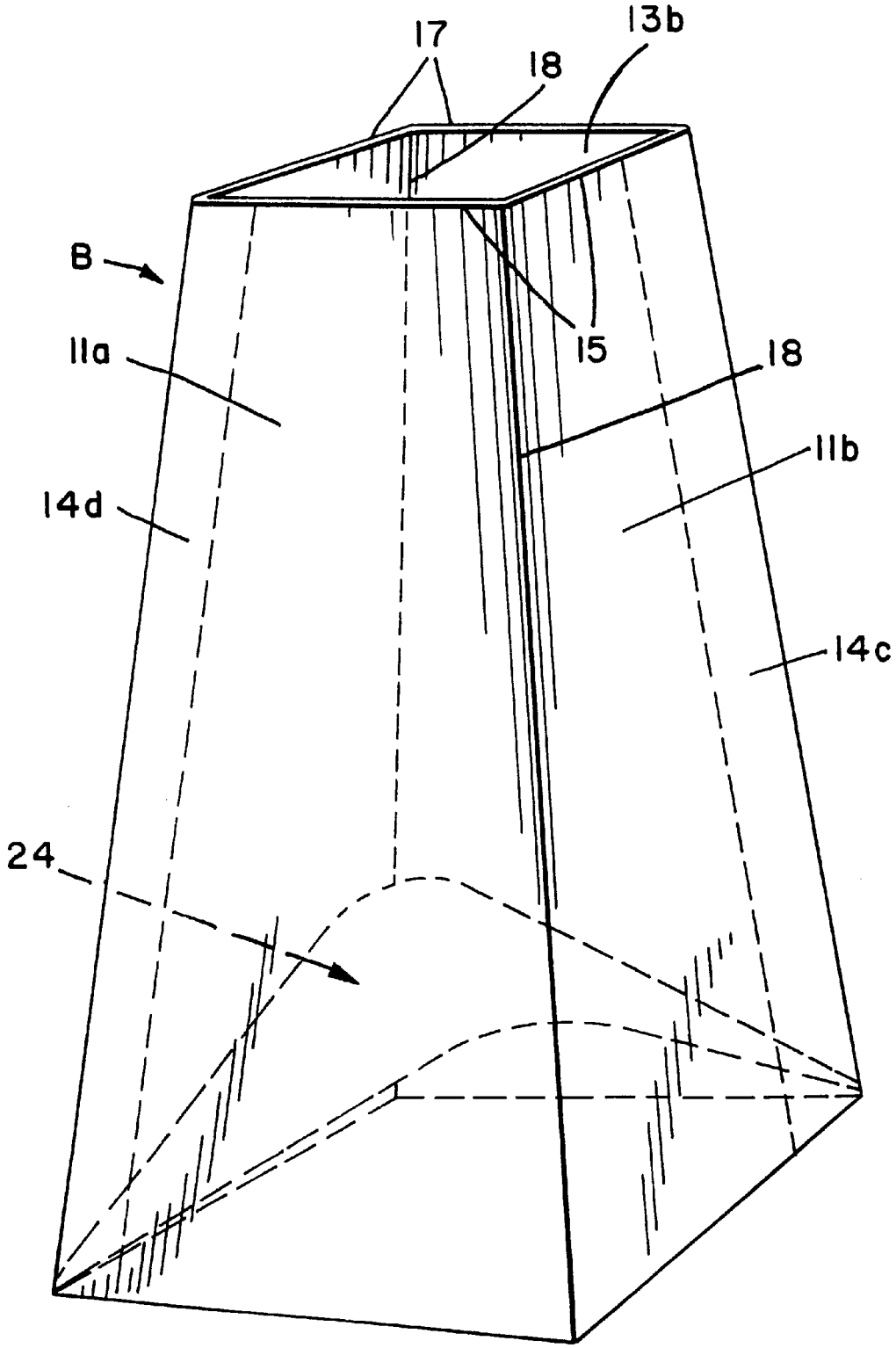
FIG. 3 PRIOR ART
FIG. 3 shows in perspective a flower vase or similar container in a use ready condition, made from the folded together container according to FIG. 2.

In FIG. 1 there is shown a blank 10 known from said patent application of liquid-resistant cardboard for making an intermediate product in the form of a folded together container A, as shown in FIG. 2 and which in turn is to be formed into a finished product in the form of a container B, which is illustrated herein in the form of a flower vase, as is shown in FIG. 3. It is a big advantage that the container is easy to transform from an intermediate product A requiring little space to a use ready condition B.

Even if herein there is specially referred to a container in the form of a flower vase it is obvious that the container can also be adapted and applied for a series of other purposes for taking up liquid or liquid containing, without examples being shown specifically of this herein.

The blank of cardboard is coated on the one side facing inwardly in the product, that is to say on the inner side 10*a* of the container (partially shown in FIG. 2) with a suitable liquid-resistant layer, such as a polyester coating, or another suitable material which can seal off the cardboard blank. By using a coating of polyester or another suitable thermoplastic can produce an adhesion effect similar by local heating or by another added agent and thereby is also employed for welding of joints along edges of the intermediate product. On the outer side lob of the product the blank can be locally impressed with text and/or ornament. For example the product can be impressed with a congratulatory greeting and/or have the possibility for additional manual inscription on a suitable area for this.

Since the intermediate product A can be handled in a folded together, relatively flat condition, the product is suited for easy manual handling and easy manual inscription in the area this is important.

In the illustrated embodiments there is employed cardboard having 0.5–1.2 mm wall thickness and with the fibre direction across the longitudinal direction of the blank, particularly in order to be able to utilise the thickness, rigidity and fibre direction of the cardboard. There is ensured an intentional "elasticity" and strength in the container in the ready-for-use condition, so that it can be gripped and handled in a reliable and stable manner with associated contents received in the inner portions 12,13 of the container.

The blank 10 is divided up into four main sections 11–14 comprising two outermost end sections 11 and 14, which will form outer sides of the object, and two middle sections 12,13, which will form inner sides of the object. The four sections are mutually separated by means of three mutually parallel, parallel extending folding lines 15,16,17. The blank is further provided with a central longitudinal folding line 18, which divides each section 11–12 into two mirror image-formed section portions 11*a*,11*b* and 12*a*,12*b* and which divides each section 13–14 into two equivalent mirror image-formed section portions 13*a*,13*b* and 14*a*,14*b* and also which divides a bottom portion 24 into four equivalent portions 24*a*–24*d*.

Along the side edges the middle sections 12,13 and the one end section are provided with edge flaps 12*c*,12*d*;

13*c*,13*d* and 14*c*,14*d*, which are defined by folding lines 19. In the central portion of the blank there are formed two substantially V-shaped folding lines 20,21 and 22,23, which define a rhombic portion, which is to form the inner bottom portion 24 of the object. As shown in FIG. 1 the portion 24 constitutes four right angled, substantially triangularly shaped portions 24*a*,24*b*,24*c*,24*d*. By means of the rhombic bottom portion the container can be made with a more or less marked rectangular bottom portion. Alternatively the folding lines 20–23 can extend with a bent or curved contour, so that there is defined an oval or more or less elliptical bottom portion (not shown further), which correspondingly can give the container a more or less rounded, that is to say oval or circular bottom portion.

The blank 10 is first folded together about the folding line 16, outer side against outer side. Thereafter the edge flaps 12*c* and 13*c* and 12*d* and 13*d* are bent round in pairs about the folding lines 19 and folded together in layers against each other. Adhesive agent is applied or alternatively there is applied in advance an adhesive agent to the blank, such as an impregnating agent in the form of polyester or other suitable thermoplastic.

Thereafter the joint connections can be adhered together, that is to say each of the opposite sides of the edge flaps, by a conventional welding operation or adhesion operation, so that a liquid-tight inner container is obtained.

Thereafter section 14 of the blank 10 is folded about the folding line 17, with abutting inner side against inner side, and the edge flaps 14*c* and 14*d* are folded on the outside of the folded together sections 12,13. Finally the section 11 is folded around about the folding line 15 and is pressed against the pack of inner sides 12,13 and edge flaps 14*c*,14*d* of the outer side 14. Finally the edge flaps 14*c*,14*d* carrying the adhesive agent or carrying the impregnating agent are firmly adhered by adhesion/welding to the section 11 via associated connection joints. If desired portions of the inner sections can be simultaneously adhered to the outer sections.

After the adhesive agent/thermoplastic has hardened the intermediate product A assumes a position as shown in FIG. 2, that is to say an intermediate product in the form of a flat container-forming pack. There is formed consequently a double-walled intermediate product having double edge joints. The one, inner joint connection seals off the inner portion of the container and the other, outer joint connection forms an enveloping, outer container portion 11,14 which braces and shores up inner portions 12,13 of the container.

In FIG. 3 there is shown the end product B according to the known construction. The end product comes to light in that the intermediate product A (FIG. 2) is squeezed together sideways, as is shown by the arrows C and D. The squeezing force will cause the bottom portion 24 to be "drawn" upwards and inwards into the container, as shown by the arrow E. Alternatively the bottom portion 24 can be pressed in with a pushing force, as is shown by the arrow E in FIG. 2. By this the bottom portion 24 will be pressed upwards and inwards in the end product by bending around about a dead centre in a plane through the folding line 18, while side walls of the container are equivalently stretched out to the form which is shown in FIG. 3. It will also be possible to effect a manual stretching out of the sides as shown by the arrows C and D at the same time as manual pressing in of the bottom portion is effected as shown by the arrow E. A container B is hereby produced, which is shown widest below and narrowest above and which is thereby well suited for example as a slim flower vase having a low centre of gravity and having a favourable bottom support effect.

On squeezing together the container B in a plane through the folding line 16 the container according to the known construction can, relatively easily, be squeezed together from the position which is shown in FIG. 3 to the position which is shown in FIG. 2.

According to the invention there is fastened a combined bottom-bracing and bottom-closing means 25 to the bottom portion 24 of the flower vase/container B1 for effectively being able to brace and close the container B1 in a use ready condition against unintentional folding together. In the illustrated embodiment the means 25 is adapted to exert an effective closing off effect, that is to say that only by a deliberate lifting of the closing engagement can the means 25 be readjusted from the active closing position, as shown in FIG. 5, to an inactive storing position, as shown in FIG. 4, in connection with an intentional readjustment of the container from a stretched out to a folded together condition.

Figure 4:
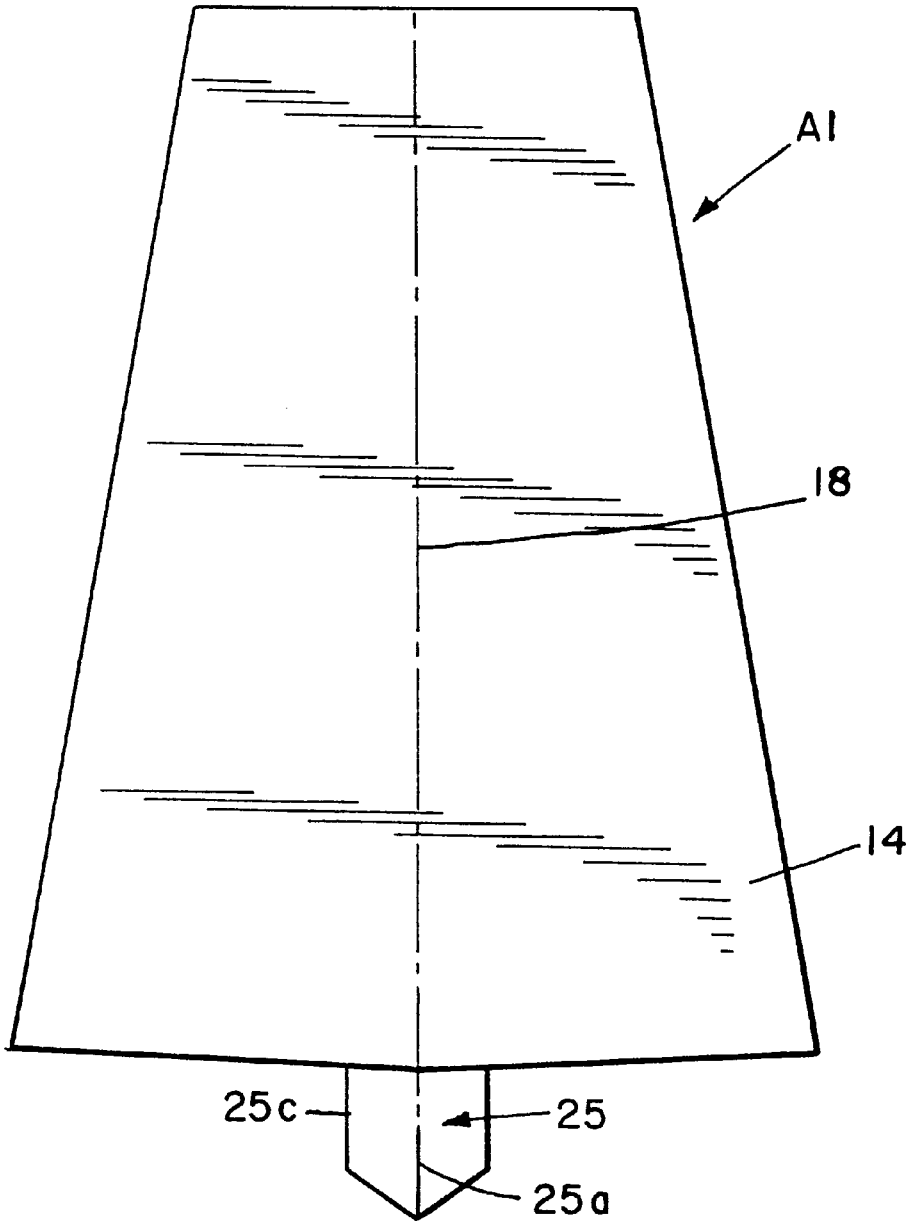
FIG. 4 shows in a plan view a flower vase in a first embodiment according to the invention, illustrated in a folded together condition with a combined bottom-bracing and bottom-closing means projecting freely outside the bottom edge portion of the flower vase.
Figure 5:
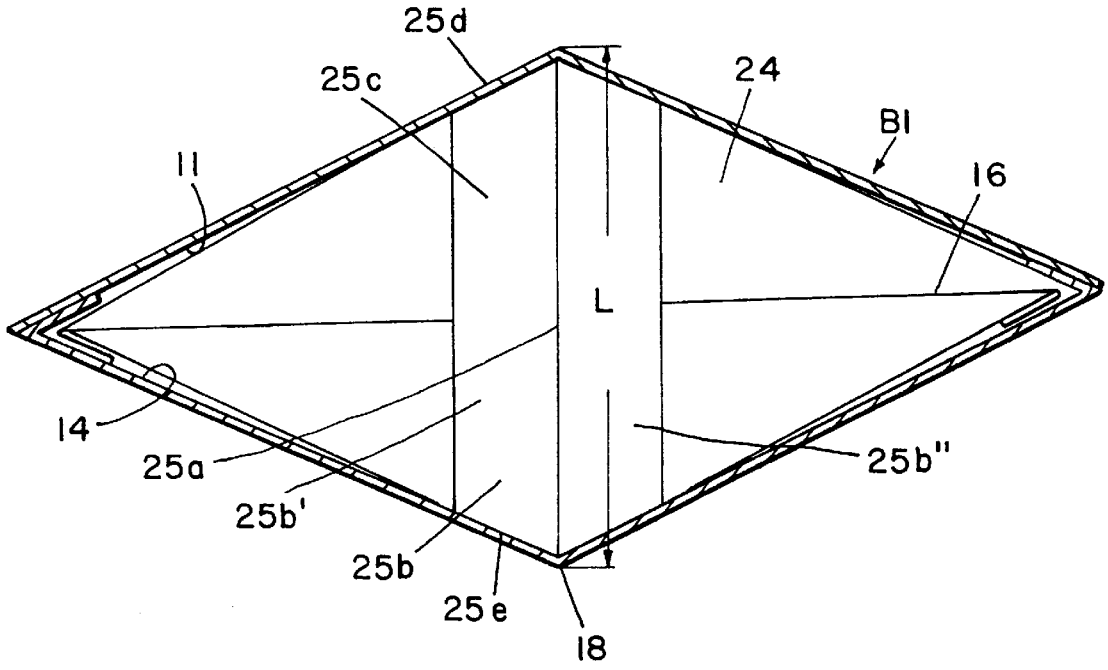
FIG. 5 shows a bottom view of the flower vase according to FIG. 4 with the bottom-bracing and bottom closing means illustrated in a closed position in the use position of the vase.

In FIGS. 4 and 5 the means 25 is shown in the form of a strip of relatively bending rigid cardboard and provided with a longitudinal, middle attenuation line 25*a*. The breadth of the strip in the illustrated embodiment is of a magnitude ⅕ the length of the bottom folding line. In practice the breadth can be considerably broader, but the container B1 then becomes more difficult to position back from the stretched to the folded together condition.

Alternatively a more shape stable strip of plastic or other suitable material can be employed.

In FIG. 4 the container/intermediate product A1 is shown in a folded together condition and the means 25 is shown in an inactive condition. One end 25*b* of the means 25 is fastened to the one half of the bottom portion 24, while its other end 25*c* projects freely outwards from the bottom portion 24 and further axially outside the container/intermediate product A1 in the folded together condition. In the illustrated construction only the one half 25*b*' of end 25*b* of the means 25 is fastened to the bottom portion, while the other half 25*b*" projects freely outwards past the attenuation line 25*a*.

In FIG. 5 the container B1 is shown in a stretched condition and the means 25 is shown in an active closing position on the under side of the middle portion of the bottom portion 24. In FIG. 5 there is shown the attenuation line 25*a* extending in a lowermost layer formed by the means 25 and the bottom folding line 16 extending in a direction crossing an upper layer formed by the bottom portion 24 of the container B1. An effective support can be achieved hereby by means of the folding edge which is formed by the attenuation line 25*a* and the elasticity in the bottom portion 24 along the outstretched folding line 16.

The means 25 becomes, as a result of it being firmly adhered to the one half of the bottom portion 24 of the container B1, swung about together with this bottom portion half from the inactive position shown in FIG. 4 to the closed position shown in FIG. 5.

The means 25 has a length L, which roughly corresponds to the internal distance between opposite sides 11 and 14 of the ready shaped container B1, so that end edges 25*d* and 25*e* of the closing means can form an endwise supporting abutment against opposite sides 11,14 of the container B1.

However on need the closing means 25 can be manually drawn away from the closing engagement and thereafter, for example by exerting a pull at the outer end 25*c* of the closing means the container B1 can be actively readjusted to the folded together condition, as shown at A1 in FIG. 4.

Figure 6:
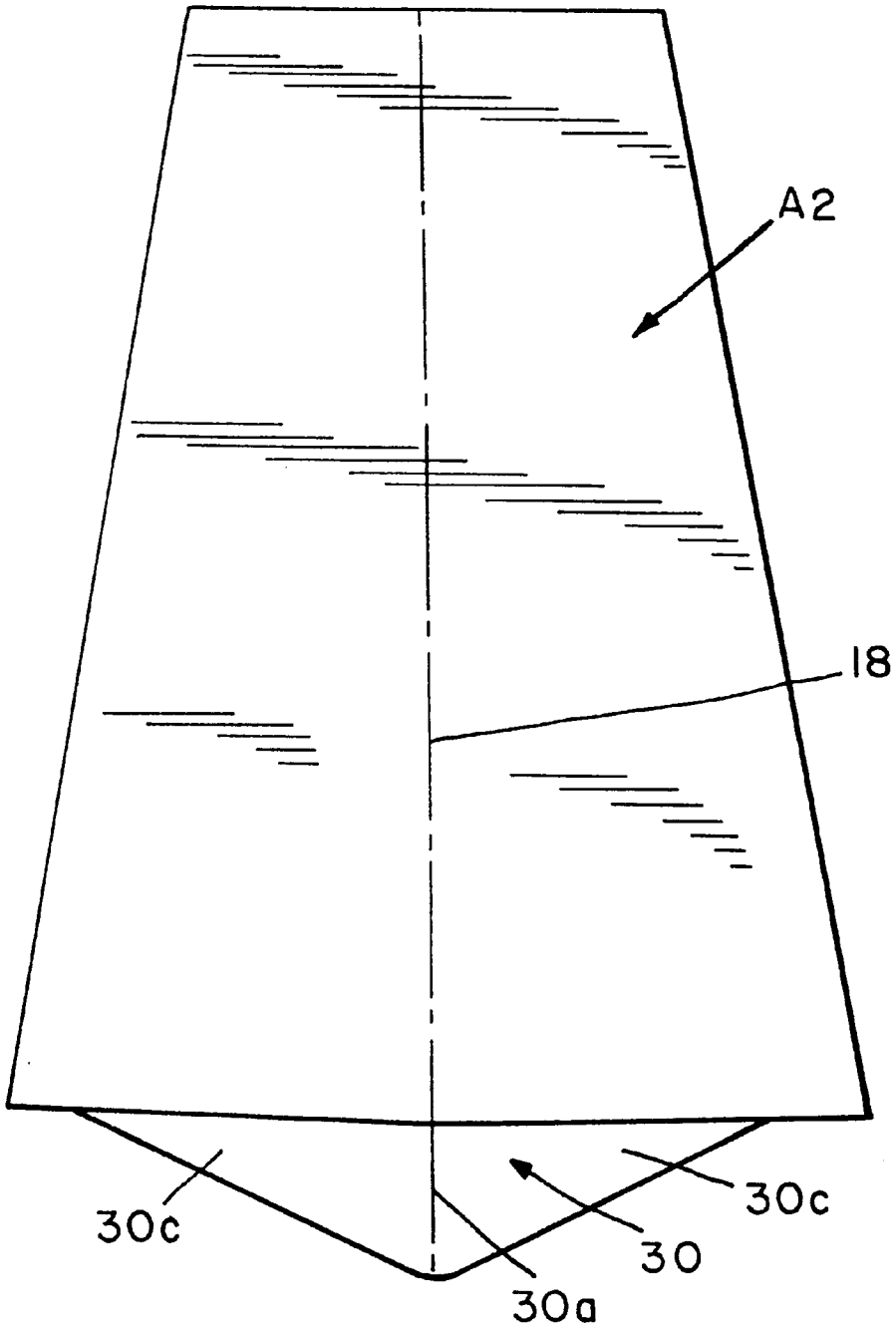
FIG. 6 shows in plan view a flower vase in a second embodiment according to the invention, illustrated in a folded together condition with a combined bottom-bracing and bottom-closing means projecting freely outside the bottom edge portion of the flower vase.
Figure 7:
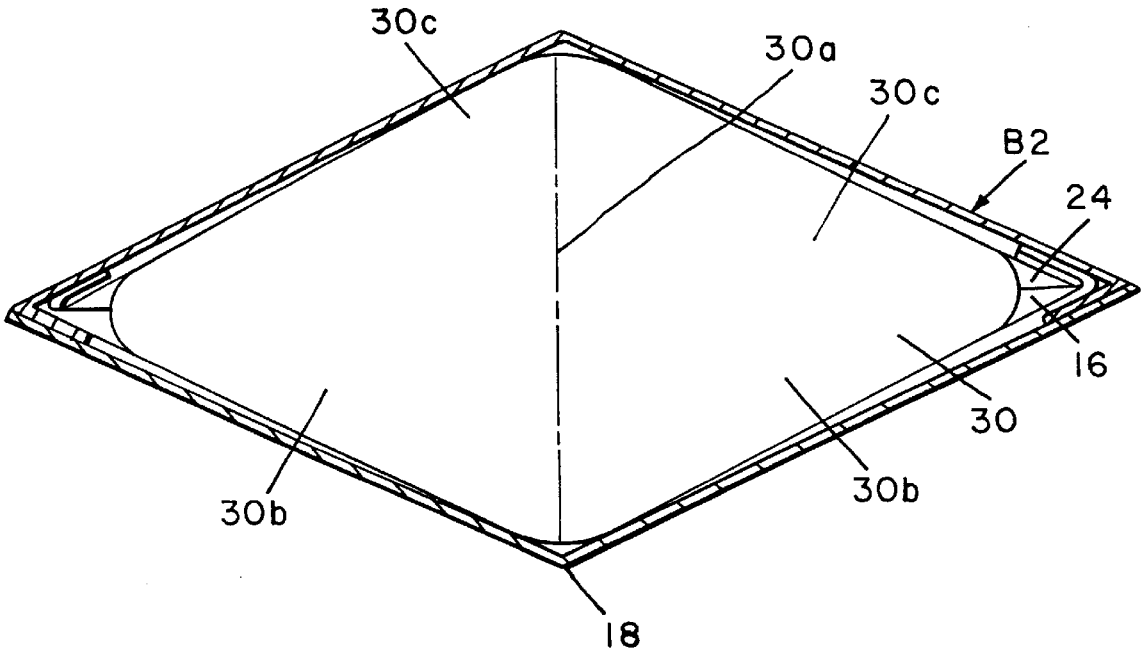
FIG. 7 shows a bottom view of the flower vase according to FIG. 6 with the bottom-bracing and bottom closing means illustrated in a closed position in the use position of the vase.

In FIGS. 6 and 7 an alternative construction of the container A2 and B2 is shown based on a bottom bracing and bottom closing means. In the use position of the container B2, as is shown in FIG. 7, the means 30 covers so to speak the whole of the bottom portion 24 of the container B2. In FIG. 7 there is shown a middle weakening line 30*a* having a contour at right angles to the bottom folding line 16, that is to say with a contour corresponding to the attenuation line 25*a* as shown in FIG. 5. Alternatively the attenuation line can be omitted. The one half 30*b* of the means 30 can be fastened to the whole under side or parts of this to the bottom portion 24, while the other half 30*c* of the means projects endwise outside the container A2, as is shown in FIG. 6.

Figure 8:
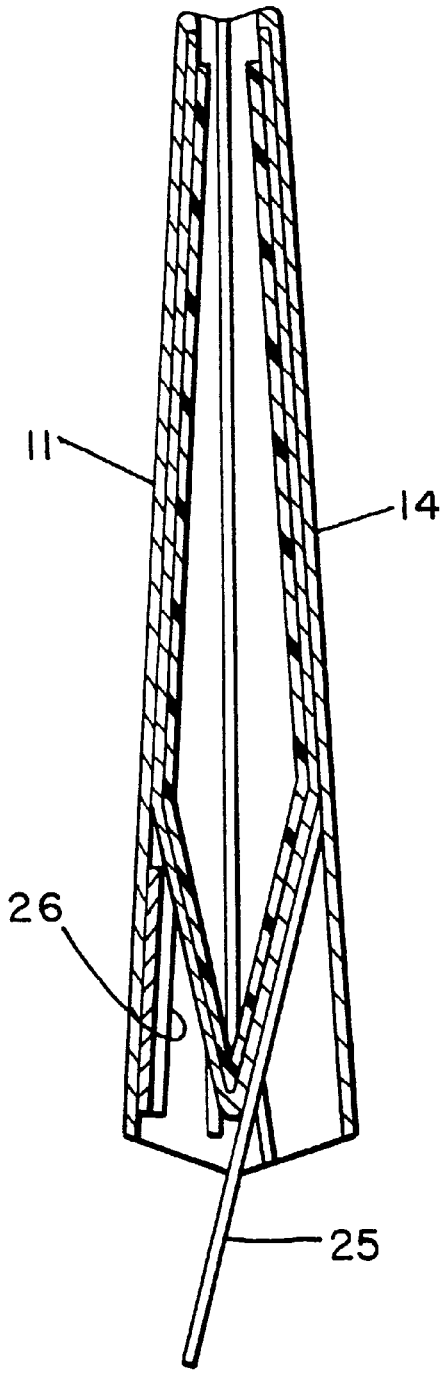
FIG. 8 shows a vertical section of a flower vase according to a third embodiment with the vase illustrated in the folded together position.
Figure 9:
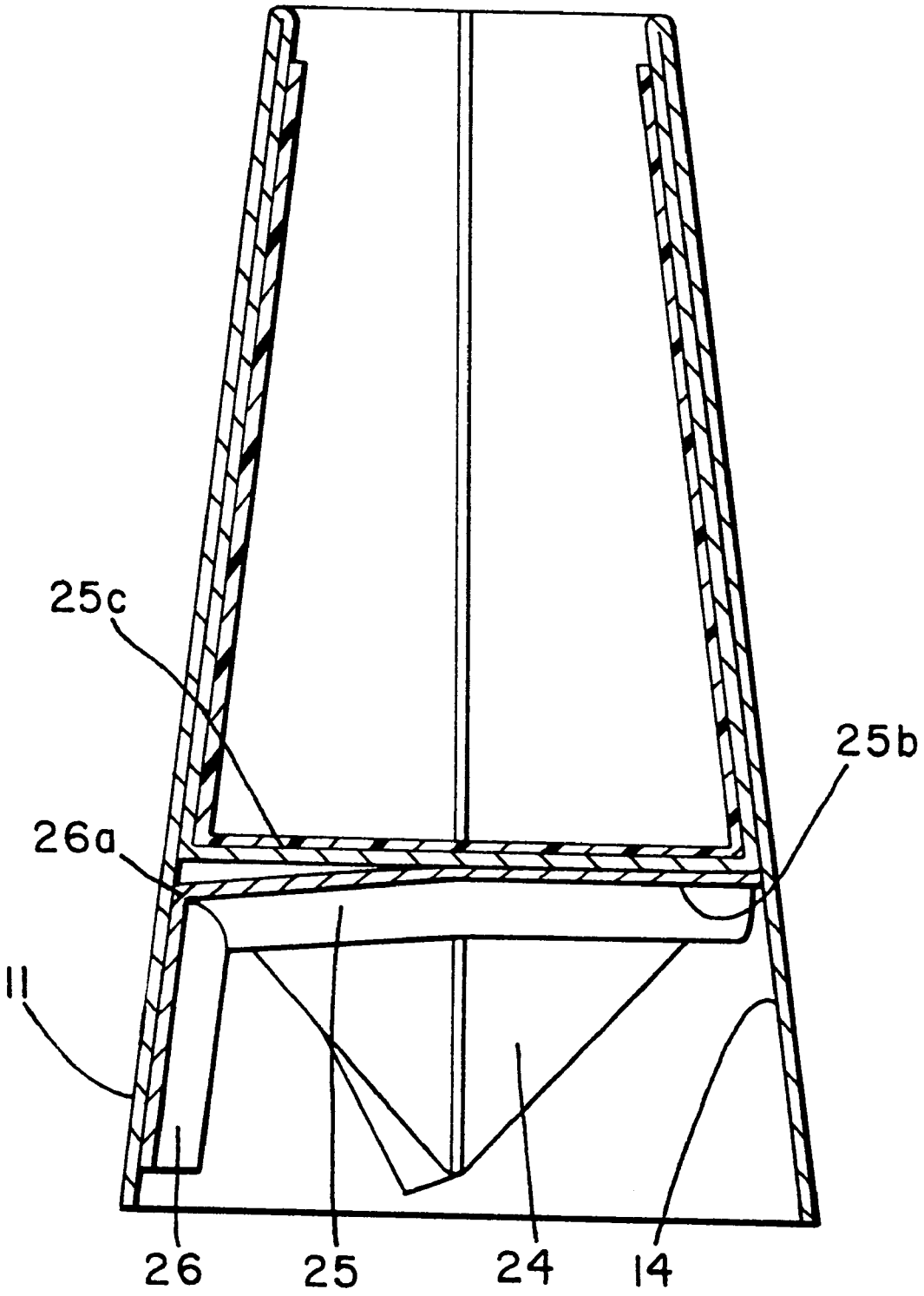
FIG. 9 shows the flower vase according to FIG. 8 in a corresponding vertical section, as illustrated in FIG. 8, in a finished use position.
Figure 10:
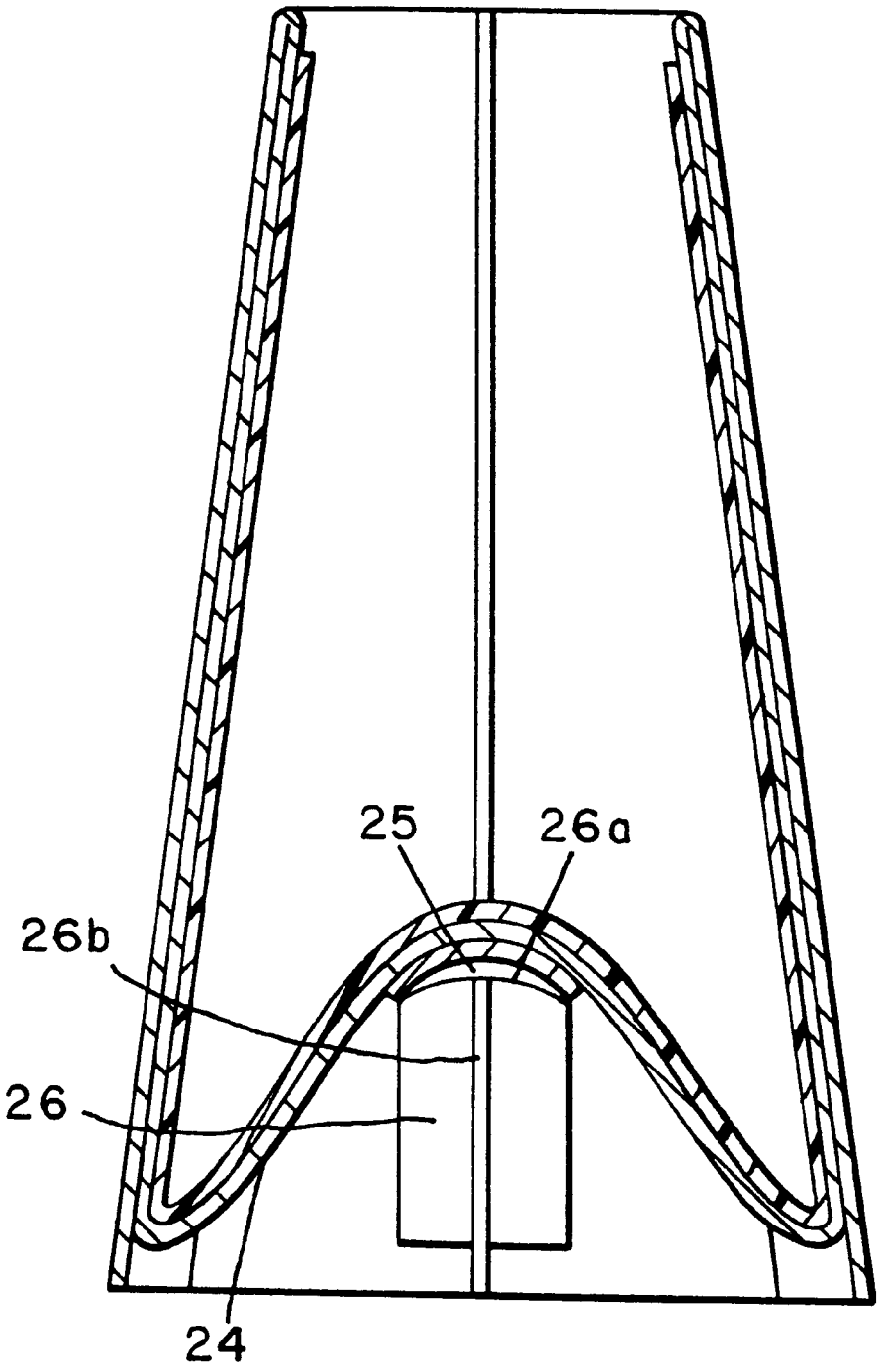
FIG. 10 shows the flower vase according to FIG. 8 in a finished use position, illustrated in a vertical section at right angles to the section of FIG. 9.

A first simple design of the closing mechanism comprises only the means 25 (FIGS. 4–5) and 30 (FIGS. 6–7) respectively, which is fastened to the bottom portion 24. In order to ensure an additional closing of the bottom portion 24 of the container in its closing position there is illustrated in FIGS. 8–10 a further embodiment having an extra stopper for a closing means corresponding to the closing means 25 according to FIGS. 4–5. In the illustrated embodiment there is a shown a closing means without the attenuation line as shown in FIGS. 4–5, so that an especially shape stable closing means of great inherent rigidity can be obtained. The stopper 26 is shown in the form of a cardboard flap, which is fastened to the inner side of the one outer wall 11 of the container. As shown in FIGS. 9–10 the closing means 25 rests in the closing position against upper edge surface 26*a* of the cardboard flap 26. The stopper 26 can, in the dimension it is employed, close the closing means in place in a permanently closed condition and in addition the stopper/cardboard flap 26 can by its fastening to the outer wall of the container locally brace this in a region just by the supporting abutment of the closing means against the outer wall of the container in order to support the outer wall in an intentionally uniform contour. In a case where there is desired a marked edged container outer wall the cardboard flap 26 can be provided with a folding line 26*b*, as is shown, while such a folding line in the cardboard flap 26 (and in the container wall 11 and 14 respectively) is omitted if such a marked edged container outer wall shall be avoided.

It is possible to give the end product a shape other than that illustrated, which has upwardly converging edges and upwardly converging outer sides. Alternatively the container can be given upwardly diverging edges and upwardly diverging outer sides, so that a container is formed having the largest breadth above and the least breadth below. Further variations can consist in employing mutually parallel edges and mutually parallel sides with a corresponding breadth above and below (not shown further).

A bouquet of flowers which is received in the vase can distribute some of the flower stems sideways on each side of the convexly curved bottom portion, with corresponding spreading out of the flower bouquet above over the upper end of the vase.

What is claimed is:

1. A container comprising:

a liquid-resistant planar blank, said blank having folding lines and edge flaps and a bottom folding line and a double foldable bottom portion, said bottom portion having halves which are adapted to be pulled in by an attached hand grip formed by a curved edge formed along the bottom folding line;

wherein the container may be folded flat along said bottom folding line and said double foldable bottom portion;

the container having a liquid-tight inner portion formed from said double foldable bottom portion and connected at opposite edges of the container inner portion to a container outer portion, which forms a bracing, enveloping outer portion for the inner portion, wherein a bottom bracing portion braces said double foldable bottom portion and opposite sides of the container in a direction across a central plane of the container through said bottom folding line of said double foldable bottom portion, said bottom bracing portion comprising a first permanent bracing section having a first and a second half which is rigidly fastened to said double foldable bottom portion on the one side of said bottom folding line, and a second readjustable bracing section, which, when the container is in a flattened position, projects freely outwards past said bottom folding line, said bottom bracing portion having inherent rigidity in a direction across said bottom folding line and having a longitudinal dimension across said bottom folding line corresponding to or substantially corresponding to the breadth of the ready-for-use container in a direction across said bottom folding line;

the container being foldable to a flattened position and expandable to an expanded position for use.

2. The container of claim 1, wherein a first half of the first permanent bracing section is rigidly fastened to said half of said double foldable bottom portion on one side of a central line which extends across said bottom folding line, the second permanent section half projecting freely outwards past said central line.

3. The container of claim 1, wherein said first bracing section is rigidly fastened to the bottom portion on both sides of said bottom folding line when said container is in the expanded ready to use position.

4. The container of claim 1, wherein said bottom bracing portion has a breadth which is at least 20% to 100% of the length of said bottom folding line.

5. The container of claim 1, wherein said bottom bracing portion has a middle attenuation line which extends across said bottom folding line, said bottom bracing portion having being adapted to support the bottom portion in the ready for use condition of the container with an upper support edge along said attenuation.

6. The container of claim 1, wherein said bottom bracing portion has opposite end edges which determine a cross-sectional form of the container at its lower end by a supporting abutment along equivalent lower inner side portions of the container in the expanded ready-for-use condition of the container.

* * * * *